US005201175A

United States Patent [19]

Kahrs et al.

[11] Patent Number: 5,201,175

[45] Date of Patent: Apr. 13, 1993

[54] HYDRAULIC ACTUATING SYSTEM AND METHOD

[75] Inventors: Manfred Kahrs, Wiesbaden; Gerhard Kunz, Linden; Franz Fleck, Langenscheid; Gerhard Schudt, Hanau, all of Fed. Rep. of Germany

[73] Assignee: Alfred Teves GmbH, Frankfurt am Main, Fed. Rep. of Germany

[21] Appl. No.: 764,879

[22] Filed: Sep. 24, 1991

[30] Foreign Application Priority Data

Sep. 27, 1990 [DE] Fed. Rep. of Germany ..... 4030570

[51] Int. Cl.[5] ..... F16D 31/02

[52] U.S. Cl. ..... 60/413; 60/468; 417/540; 91/462

[58] Field of Search ..... 60/413, 418, 468, 492; 417/540; 91/462; 92/130 R

[56] References Cited

U.S. PATENT DOCUMENTS

| | | | |
|---|---|---|---|
| 2,566,381 | 9/1951 | Svenson | 60/418 X |
| 3,321,909 | 5/1967 | Gordon | 60/413 X |
| 3,375,760 | 4/1968 | Taplin | 92/139 R X |
| 4,458,791 | 7/1984 | Schneider et al. | 60/413 X |
| 5,096,400 | 3/1992 | Budecker et al. | 417/540 |

FOREIGN PATENT DOCUMENTS

| | | | |
|---|---|---|---|
| 2324059 | 11/1974 | Fed. Rep. of Germany . | |
| 108004 | 8/1979 | Japan | 417/540 |
| 2036873 | 7/1980 | United Kingdom | 417/540 |

OTHER PUBLICATIONS

Rückblick auf die Deutsche Industriemesse Hannover 1960, Dr. Ing A. Welte, pp. 375-388, Dec. 1060.

*Primary Examiner*—Edward K. Look
*Assistant Examiner*—Todd Mattingly
*Attorney, Agent, or Firm*—Robert P. Seitter; J. Gordon Lewis

[57] ABSTRACT

A hydraulic actuating system and method comprises a pump which continuously circulates hydraulic fluid out of a reservoir into a pressure line limited to a predetermined maximum pressure by a pressure-limiting valve and a control valve connected to the pressure line controlling flow of hydraulic fluid to an operating cylinder. A clearance volume in communication with the pressure line collects compressed air entrained in the hydraulic fluid flow which upon opening of the inlet valve expands to displace a portion of the volume of flow of hydraulic fluid required for actuation of the operating cylinder.

7 Claims, 1 Drawing Sheet

HYDRAULIC ACTUATING SYSTEM AND METHOD

BACKGROUND OF THE INVENTION

The present invention relates to a hydraulic actuating system comprising a pump which, in operation, continuously supplies fluid out of a reservoir into a pressure line, in combination with a pressure-limiting valve recirculating flow to limit the pressure in the pressure line, with a control valve connected to the pressure line, and with an expansible chamber actuating device such as an operating cylinder which is connectable to the pressure line via the control valve.

Actuating systems of this type are commonly known, see e.g. the journal 'Konstruktion 12' (1960), volume 9, page 380, pictures 13 and 17, and are typically of simple construction. A disadvantage of these actuating systems is that, in order to attain high speed operation of the operating cylinder, pumps with a correspondingly great displacement volume are required. However, such large pumps must be of increased design strength and require increased space. Large displacement pumps increase the energy demand, which has to be considered as loss in the periods of operation in which the control valve is closed and the delivery flow of the pump is discharged through the pressure-limiting valve such that no work output is realized.

Hydraulic actuating systems are further known (see German published patent application 23 24 059, as an example) wherein the pump charges a pressure accumulator from which hydraulic fluid flows for use by the operating cylinder. These systems are comparatively sophisticated because they necessitate a pressure accumulator with a gas chamber separated by a diaphragm or a piston, and usually also an accumulator-charging valve.

It is the object of the present invention to enable an increase in the speed of operating of the operating cylinder in a hydraulic actuating system of the above type beyond the extent predetermined by the fluid delivery rate of the pump without the employment of conventional pressure accumulators.

SUMMARY OF THE INVENTION

This object is achieved by a system according to the present invention in that, due to a space included in the flow passages, an accumulation of a volume of air is retained in the flow passages to the operating cylinder and in a chamber in communication with the flow passages. The air volume is compressed by the hydraulic fluid so that upon opening of the inlet valve, the compressed air volume expands to displace a part of the volume of hydraulic fluid flow required for operation of the operating cylinder or other expansible chamber actuator.

The present invention serves to utilize a difference in pressure between the higher system pressure and the lower operating pressure acting to compress the volume of air which is entrained in hydraulic systems as by foaming in the reservoir and by other effects in the form of small bubbles in order to accomplish an accumulating effect. This effect augments the flow delivery by the pump, and thus delivers part of the flow required for operation of the actuating device and thereby increases the speed of operation considerably for a given pump size. The additional structure needed is surprisingly little since it is generally sufficient for achieving the inventive effect to retain the necessary air volume by forming a small clearance volume in the housing of the pump or the control valve or within the pressure line located to collect the air in the system.

Instead of designing a special clearance volume, provision can be made according to another form of the invention to enlarge the cross-sectional area of the pressure line to such extent that the pressure fluid volume enclosed therein contains the necessary air volume.

When the quantity of air entrained in the flow at hydraulic fluid is too small, the pump may include means enhancing the entrainment of air into the hydraulic fluid flow.

In order to avoid the development of air locks in the actuating device, the pressure-limiting valve can be arranged such that excess air is evacuated from the operating cylinder expansible chamber to the reservoir. Furthermore, it can be ensured according to this invention by suitably positioning the ports, that air out of the operating cylinder chamber is discharged to the reservoir in the unpressurized condition.

The invention is particularly suited for operating cylinders with small cylinder volumes, which are typically employed for performing regulating actions in automotive vehicles. It has proven that the retained air volume sufficient to be effective amounts to roughly 20 to 50% of the flow volume required to operate the actuator device.

DESCRIPTION OF THE DRAWINGS

The present invention will be described in more detail hereinbelow by way of an embodiment illustrated in the accompanying drawing. In the drawing.

DETAILED DESCRIPTION

Figure 1:
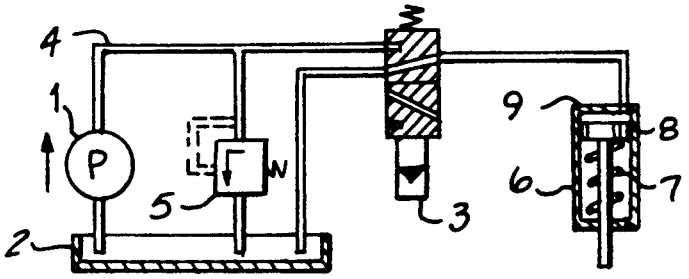
FIG. 1 is a circuit diagram of a hydraulic actuating system according to the invention.

The actuating system shown in FIG. 1 comprises a continuously operated pump 1 which supplies fluid out of a reservoir 2 into flow passage means including a pressure line 4 leading to a control valve 3. The pressure in the pressure line 4 is limited by a pressure-limiting valve 5 to a maximum value termed as "system" pressure set to be in excess of the pressure required to operate an expansible chamber actuator, such as the hydraulic cylinder 6 shown.

The cylinder 6 is connected to the pressure line 4 by an electromagnetically operated control valve 3. The operating cylinder 6 has a piston 8 which, by pressurization of a chamber 9 above the piston 8, is displaced in opposition to a compression spring 7. The expansible pressure chamber 9 of the cylinder 6 is periodically connected through the control valve 3 to the pressure line 4 and at all other times to the unpressurized reservoir 2. When the pressure chamber 9 is connected to the pressure line 4, the piston 8 will be displaced resulting in a lower chamber pressure than the system pressure set by the pressure-limiting valve 5.

The line to the chamber 9 is located at the top of the cylinder 6 so that air in the chamber 9 will be evacuated to the reservoir 2 by return of the spring urged piston 8, upon opening of the valve 3 to connect the chamber 9 to the reservoir 2.

Figure 2:
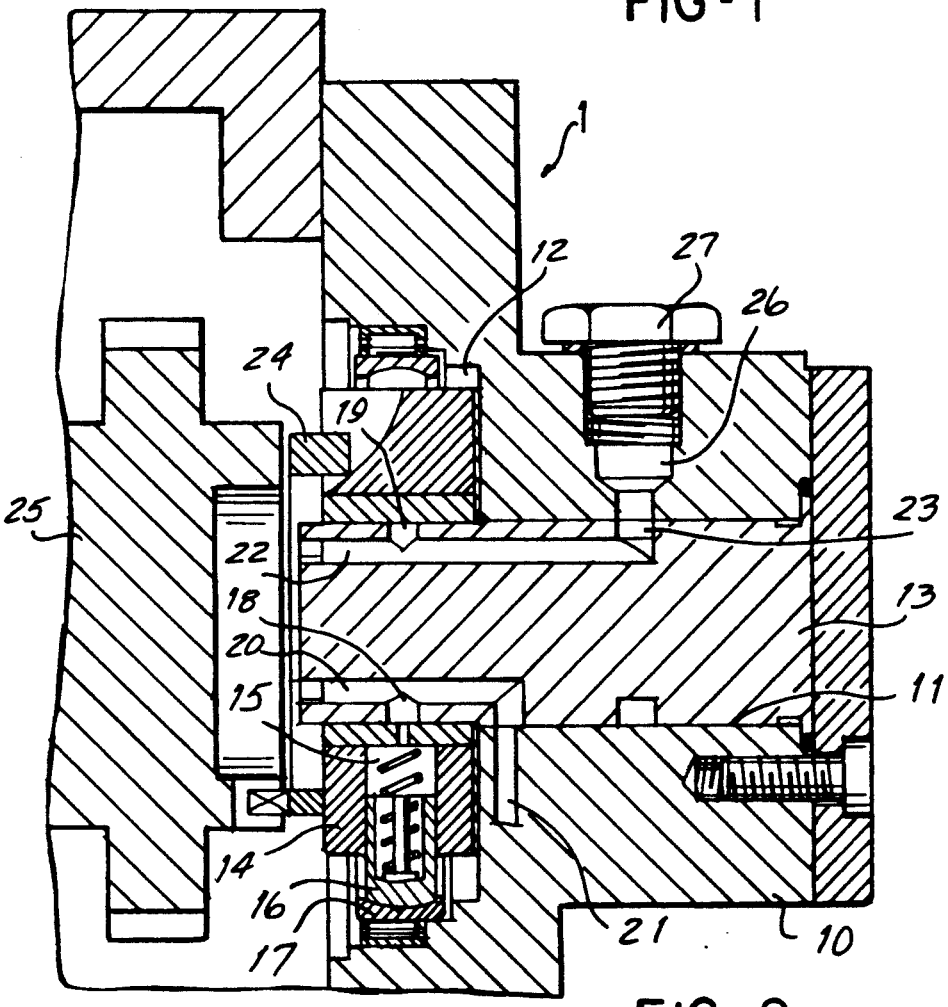
FIG. 2 is a cross-section taken through a radial piston pump with a clearance volume connected to the pressure line.

FIG. 2 illustrates the pump 1 in cross-section. A radial piston pump housed in a pump housing 10 is formed with a longitudinal through-bore 11 and a succeeding cylindrical recess 12. A control pin 13 is attached in the longitudinal bore 11, for instance by being forced therein, and projects into the recess 12. A rotor 14 is rotatably mounted on the control pin 13 in the recess 12. The rotor 14 incorporates a number of radially aligned cylinder bores 15 in each of which a respective one of a number of pistons 16 is slidably received. The pistons 16 are supported with their radially external ends on the inner surface of a stroke ring 17 which is pivotably mounted in the recess 12, by means of a roller bearing as shown. The stroke ring is mounted eccentrically relative to the control pin 13.

Two control slots 18, 19 are in the control pin 13 in the plane of the cylinder bores 15, and, on rotation of the rotor 14, subsequently move into communication with the individual cylinder bores 15. The control slot 18 connects via a longitudinal channel 20 and a bore 21 with a suction port in the housing 1 lying outside of the drawing plane. A longitudinal channel 22 leads from the control slot 19 to an annular groove 23 which is in communication with a pressure port lying outside of the drawing plane and connecting to the pressure line 4. The rotor 14 is driven via a coupling 24 by a shaft 25, for instance the cam-shaft of an internal-combustion engine.

In the envisaged mounting position of the pump 1, the annular groove 23 is connected at its highest point to a radially upwardly extending housing bore 26 which is sealed from the outside by a screw plug 27. A clearance volume of defined magnitude is formed by the housing bore 26, and, on operation of the pump 1, the bore 26 accumulates air bubbles which are carried along by the flow of hydraulic fluid on the way from the longitudinal channel 22 to the annular groove 23. The air bubbles can ascend into the housing bore 26 before the hydraulic fluid flows completely through the annular groove 23 to the pressure port.

This arrangement causes the housing bore 26 to gradually fill with air which is compressed by the comparatively high system pressure when the control valve 3 is closed. Once the control valve 3 is operated and the pressure line 4 is connected to the operating cylinder 6, the air enclosed in the housing bore 26 will expand due to the pressure in the pressure line 4 decreasing to the lower operating pressure in the chamber 9, thereby forcing a volume of hydraulic fluid into the chamber 9. This air expansion induced flow adds to the delivery flow of the pump 1 As a result, the required volume of flow to the chamber 9 of the operating cylinder 6 will occur more quickly, and a correspondingly shorter operating time will be achieved. In practical tests a reduction of the regulating time of more than 30% could be achieved by the described measure.

The clearance volume formed by the housing bore 26 is suitably dimensioned to be of such size that it can receive the effective volume of air compressed under system pressure during operation i.e., 20–50% of the flow volume required by the operating cylinder 6. When the air expands during the transition to the operating pressure by switching of the control valve 3, part of the air contained in the clearance volume will escape and finally will leave the system towards the reservoir 2 when the control valve 3 is switched back. This portion of air will be replaced again by the circulation of air bubble containing hydraulic fluid after the end of the actuation occurring during renewed build-up of the system pressure.

Figure 3:
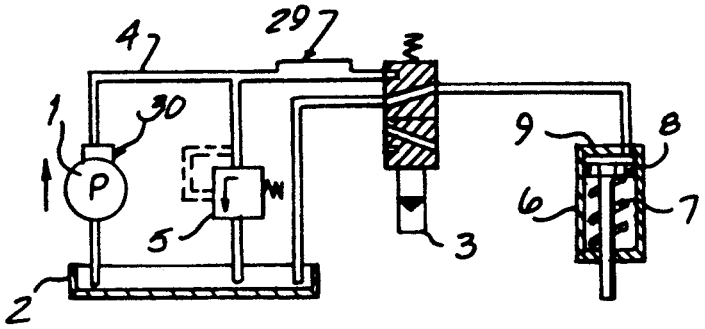
FIG. 3 is a circuit diagram of a hydraulic actuating system according to the present invention incorporating alternate features.

FIG. 3 shows an air indication device 30 added to the pump 1 where this is necessary to achieve the necessary air volume. Also, an enlarged section 29 of the pressure line 4 is used to accumulate the air volume upstream of the control valve 3.

We claim:

1. A hydraulic actuating system comprising:

an actuating device including an output member and a chamber expansible against fluid pressure to cause movement of said output member, said actuating device operable by a predetermined operating pressure;

a reservoir of unpressurized hydraulic fluid;

a continuously operated pump having a suction drawing hydraulic fluid out of said reservoir and an outlet receiving a flow of pressurized hydraulic fluid at a predetermined flow rate;

flow passage means receiving pressurized hydraulic fluid from said pump outlet and directing the same to said expansible chamber of said actuator device;

control valve means interposed in said flow passage means normally blocking communication between said pump outlet and said expansible chamber, but selectively operable to establish a period of communication therebetween;

pressure limiter means connected upstream from said control valve means causing a diverted return flow of hydraulic fluid to said reservoir to limit the pressure in said flow passage means to a predetermined maximum pressure substantially in excess of said operating pressure of said actuating device;

a fixed volume air chamber defined above said flow passage means upstream of said control valve and communicating with said flow passage means to collect air bubbles entrained in said flow of hydraulic fluid prior to opening of said control valve means and establish a volume of air compressed to a pressure substantially in excess of said operating pressure, whereby an accumulating effect is produced, and upon opening of said control valve means, said volume of air expands to create an increased rate of flow to said actuating device in excess of said predetermined flow rate of said continuously operated pump.

2. The actuating system according to claim 1 wherein said pump includes a housing and wherein said flow passage means includes an annular flow passage formed in said pump housing, and wherein said air chamber comprises a bore in said housing extending up from the top of said annular passage.

3. The actuating system according to claim 1 wherein said actuating device requires a predetermined volume of flow to said expansible chamber to perform an actuation cycle, and wherein said fixed volume air chamber has a volume in the range of 20–50% of said predetermined volume.

4. The actuating system according to claim 1 wherein said control valve means includes means connecting said expansible chamber to said reservoir whenever communication of said flow passage means with said expansible chamber is not established, and a conduit extends from the top of said expansible chamber to said control valve means to enable outflow of air therefrom.

5. A method of actuating a hydraulic actuator device comprised of an expansible chamber of a predetermined expanded volume and an output member movable by flow of hydraulic fluid to said expansible chamber under a predetermined operating pressure, comprising the steps of:

continuously drawing hydraulic fluid from an unpressurized reservoir and pumping pressurized hydraulic fluid drawn out of said reservoir into flow passage means at a predetermined flow rate and at a pressure substantially above said predetermined operating pressure, while blocking flow to said actuator device;

recirculating flow of hydraulic fluid back to said reservoir to maintain said pressure in said flow passage means while flow to said actuator device is blocked;

entraining air bubbles in said recirculated flow of hydraulic fluid;

collecting a volume of compressed air bubbles while said fluid flow is recirculated; and opening communication of said flow passage to said expansible chamber, said volume of air expanding as said output member moves so as to assist the discharge of flow of hydraulic fluid into said expansible chamber when said flow of pressurized hydraulic fluid is established to said expansible chamber whereby the rate of flow to said actuator device is greater than the rate of flow produced by said pump.

6. The method according to claim 5 wherein the volume of compressed air bubbles collected comprises 20–50% of the total volume of fluid flow to said expansible chamber.

7. The method according to claim 6 further including the step of venting the top of said expansible chamber whenever said fluid flow thereto is blocked.

* * * * *